US006484909B1

(12) United States Patent
Valpuesta Landa

(10) Patent No.: US 6,484,909 B1
(45) Date of Patent: Nov. 26, 2002

(54) TAMPER-PROOF DEVICE APPLICABLE TO TUBE-CAP ASSEMBLIES

(75) Inventor: Juan Ignacio Valpuesta Landa, Vitoria (ES)

(73) Assignee: Tuboplast Hispania .S.A (ES)

( * ) Notice: Subject to any disclaimer, the term of this patent is extended or adjusted under 35 U.S.C. 154(b) by 0 days.

(21) Appl. No.: 09/763,640

(22) PCT Filed: Jun. 14, 2000

(86) PCT No.: PCT/ES00/00212

§ 371 (c)(1),
(2), (4) Date: Apr. 19, 2001

(87) PCT Pub. No.: WO01/00499

PCT Pub. Date: Jan. 4, 2001

(30) Foreign Application Priority Data

Jun. 24, 1999 (ES) ..... 9901411

(51) Int. Cl.[7] ..... B65D 47/10

(52) U.S. Cl. ..... 222/541.5; 222/541.6; 222/541.1; 222/556; 222/153.06

(58) Field of Search ..... 222/556, 541.1, 222/541.5, 541.6, 541.9, 153.06, 153.07; 215/253, 250

(56) References Cited

U.S. PATENT DOCUMENTS 4,157,765 A 6/1979 Golebiewsky
4,193,519 A * 3/1980 Dubach et al. ..... 222/111
4,662,529 A * 5/1987 Moore ..... 215/32
4,747,501 A * 5/1988 Greaves ..... 215/253
5,007,546 A * 4/1991 Rose et al. ..... 215/32
5,076,474 A * 12/1991 Hansen ..... 222/420
5,158,192 A * 10/1992 Lataix ..... 215/32
5,203,838 A * 4/1993 Schneider ..... 215/253
5,207,657 A * 5/1993 Gibilisco ..... 604/295
5,228,593 A * 7/1993 O'Meara ..... 222/41
5,547,091 A * 8/1996 Neveras et al. ..... 215/237
5,586,672 A * 12/1996 Schneider et al. ..... 215/250
6,050,434 A * 4/2000 McNab ..... 215/235

FOREIGN PATENT DOCUMENTS

EP 0 192 011 A1 8/1986
GB 2 269 583 2/1994

* cited by examiner

*Primary Examiner*—Henry C. Yuen
*Assistant Examiner*—F. Nicolas
(74) *Attorney, Agent, or Firm*—Browdy and Neimark, P.L.L.C.

(57) ABSTRACT

A tamper-proofing device for units consisting of a container tube (1) with a neck (5) to allow the product to leave the container, and a top (2) with a lower section (3) connected to the tube (1), in addition to a hinged lid (4) for this section which closes over. The neck passes through the lower section (3) to connect with a projection on the bottom of the lid (4).

6 Claims, 2 Drawing Sheets

X
X
5
8
9
12
13
4
11
14
18
19
20
15
16
17

TAMPER-PROOF DEVICE APPLICABLE TO TUBE-CAP ASSEMBLIES

The invention relates to a tamper-proofing device for units which consist of a tube containing a certain product and a cover in two sections—a lower section attached to the tube, and a lid hinged to the tube which opens and closes with respect to the lower section.

This type of container generally bas a projection at the bottom of the upper hinged section wich fits into a hole on the upper section of the lower part of the lid, when the upper section is in the closed position.

The lower section of the lid is threaded over a section projecting in the direction of the underside of its upper section to a wide neck on the tube. In this way the hole at the centre of the upper section allows the product out of the tube when tie hinged area is open, and prevents this when the binged area closes over.

Obviously the tube-lid connection is executed with both threaded sections of a considerable diameter, and closure of the product takes place when the projection on the hinged area moves into the hole in the upper section of the lower part of the lid.

As a general rule, in order to tamper-proof these items to show interference with the container, the normal solution connects the two sections of the lid, so that when the state of the tamper-proofing devices has been altered, this is an indication that the container has been modified with regard to the correct position provided by the manufacturer.

Such conventional techniques make use of items added to both parts of the lid during the manufacturing process for the lid, and occasionally any alteration of the container is plainly visible due to modification of these additions.

Such alterations usually involve a number of drawbacks front the point of view of aesthetics: for example, in the case of containers which frequently contain expensive or beauty products, among others, and so they are often turned down on commercial circuits.

One aim of this invention is a tamper-proofing device which transfers the seal to the lid's interior to ensure non-interference, using the same items as for a conventional unit.

Another aim of this invention is a tamper-proofing device which connects the position of the usual finger flap on this type of lid to the vertical line of the main depression on the tube.

A further aim of the invention is a tamper-proofing device which is simple and therefore economic to manufacture.

In order to meet these objectives, the invention consists of a section composed of a container tube with a neck to allow the product out, and a top with a lower section attached to the neck of the tube. The lower section has an upper surface with a hole at its centre for the product in the tube to move through, and a lid is hinged to this lower section.

Specifically, the invention features a tube neck which acts as a housing for the lower part of the lid, and also passes through the hole on the upper surface of a this lower section to reach the recess between the two sections of the The hole in the lid on its lower section and the neck of the top may use any means to ensure a stable position between both, and the end of the neck which moves into the top's recess is blind, i.e. closed, and so the product cannot escape since it is fitted with a tab.

The end of the neck connects with the bottom of the hinged lid, and logically makes contact with the bottom at the centre of the cover. There is a snap connection between the end of the neck and the bottom of the lid.

In this way the lid may have a projection and the end of the neck may have a recess or vice-versa, i.e. the lid may have a recess and the end of the neck may have a projection, so that when the lid is in the closed position both snap together in such a way that the lid may nevertheless open or close whenever this is required.

If, with the lid in the closed position, the top is rotated over the tube to snap the two parts together, this will invariably lead to breakage of the end or tab of the neck of the tube, and the product is free to come out. This produces unmistakable evidence that the container has been tampered with.

To rotate the cover in this way, the connection between the lid and the base of the neck of the tube allows movement to be carried out, as shown below on the attached drawings.

Another factor which can be of assistance with the more immediate and complementary demonstration of tampering is the position of the vertical line of the finger tab with the front depression on the tube.

The market for these products normally recommends that this position be matched, and all manufacturers place the lid and the tube with the tab and the main front depression in vertical alignment. In this way, if the container is in this predetermined position, rotation of the top could alter this position, and so give rise to suspicion of tampering.

However, since this measure is advisable but not necessary in view of the normal tendency, the vertical line between the tab and the depression can be off-centred following rotation of the lid, centred prior to and following rotation, or centred only after rotation.

This and other potential advantages of the invention may be examined in more detail on the two sheets of drawings attached. With no restrictions whatsoever, these show the following:

FIG. 1 shows the tube (1) and its neck (5) protuding from the upper section (10) in the recess belonging to the hinged lid (4) and the lower section (3).

Figure 3:
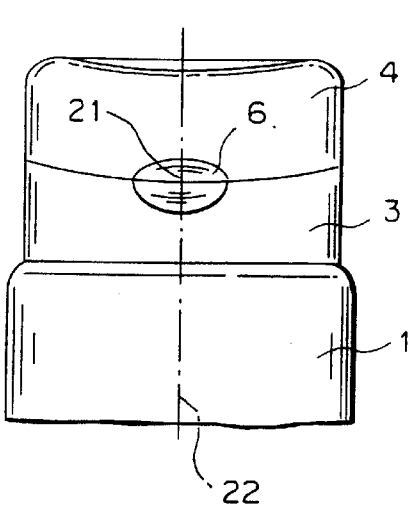
FIG. 3 shows an external side view of the container from the left-hand side of FIG. 1.

The hinged section (4) rotates around (6), and the opposite side features the projecting flap (7) which is pulled up to open the hinged section (4). The lower section (3) of the lid connects to the base of the neck (5) at its centre (9), and its external sweep covers the conical upper section of the tube.

The upper end of the neck (5) is housed in a projection at the bottom of the hinged lid (4), with is section in the closed position.

Figure 2:
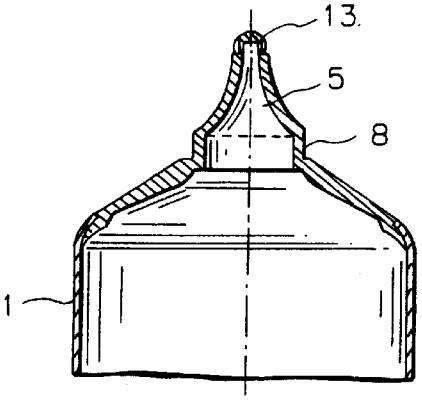
FIG. 2 shows a cross-section of the tube.
Figure 1:
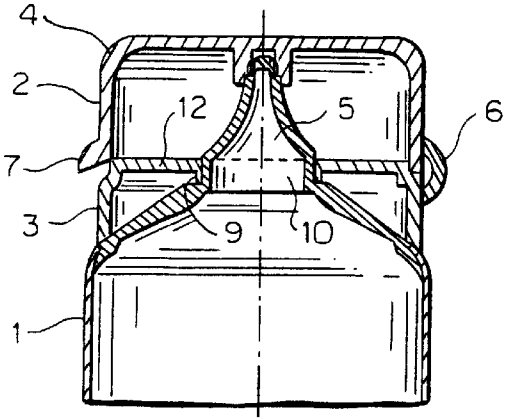
FIG. 1 shows an elevation of the container concerned.
Figure 4:
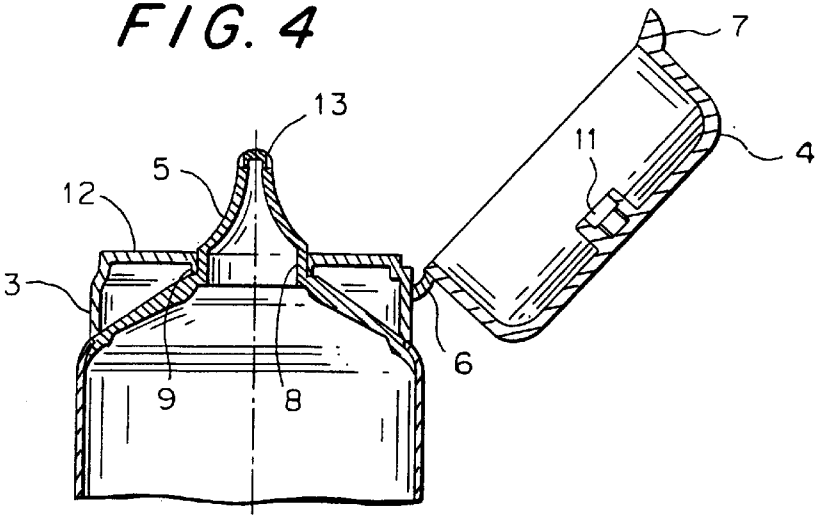
FIG. 4 shows the container with its lid us the open position.

FIG. 4 shows section (4) in the open position, and the projection (11) which houses the tab (13) on the neck (5) of the tube. In both FIG. 1 and FIG. 4, the container is completely sealed since the tab (13) does not allow the product to leave the tube (1), as shown in FIG. 2.

Figure 5:
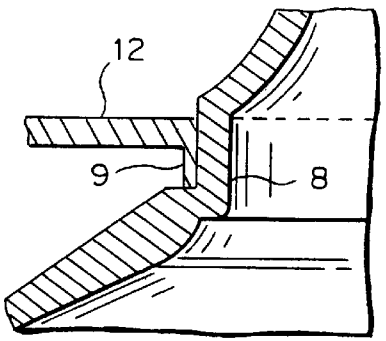
FIG. 5 shows a closure detail between the top and the neck of the tube.

FIG. 5 shows, on the upper surface (12) of the lower section (3) of the lid (2), the area (9) connecting with the tube (1) at the base (8) of the neck (5) to allow the neck through.

As mentioned above, the tab (13) closing off the neck may be of any shape, forming a projection (FIG. 6) of a certain cross-section, and so the projection (11) on the bottom of the lid (FIG. 7) makes up a recess (14) of a section matching that of the tab (13), and the resultant snap connection breaks the tab when the top (2) is rotated.

Figures 6, 7, 8:
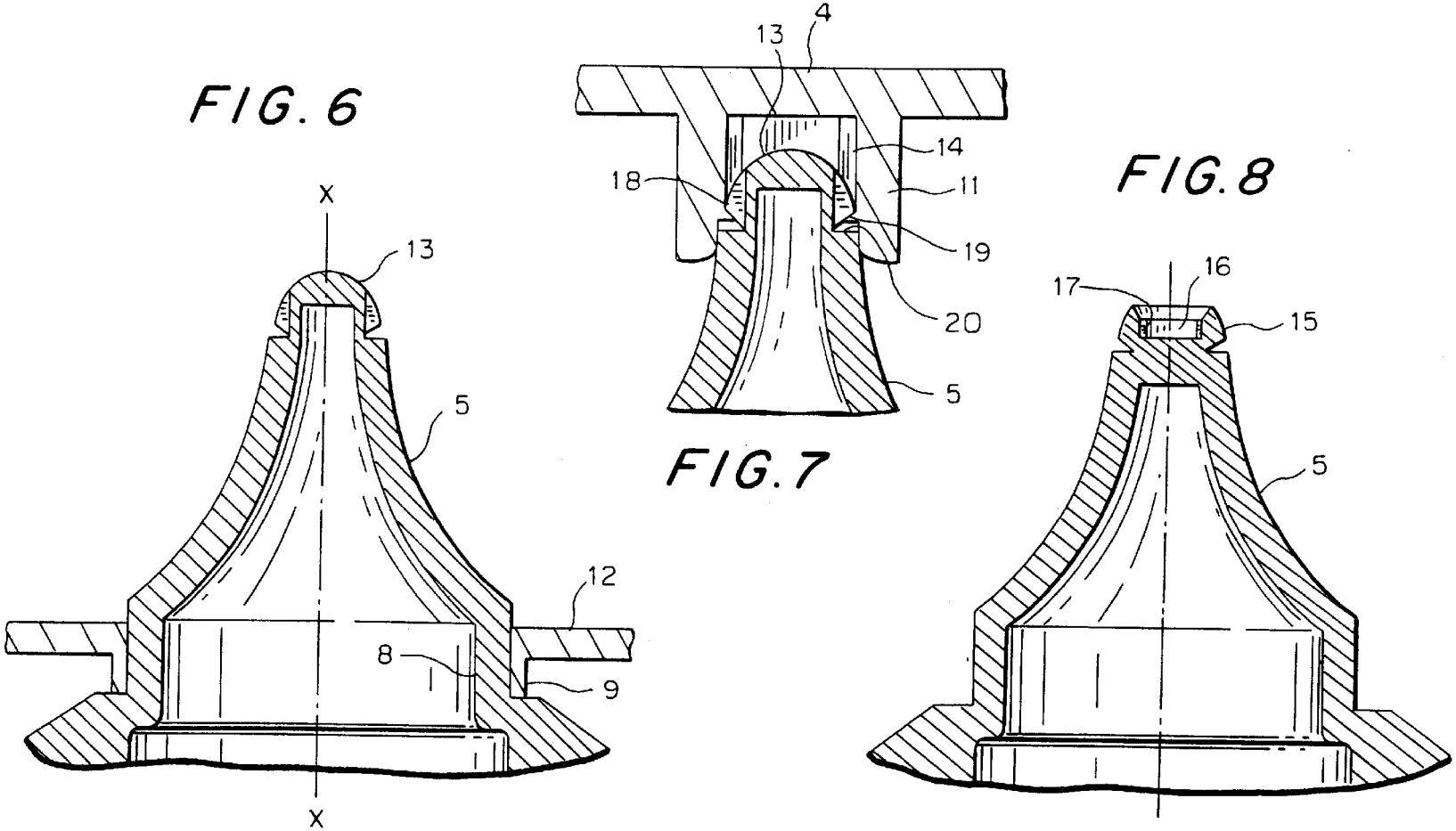
FIG. 6 shows a large illustration of the end of the neck of the tube with a tab projection.
FIG. 7 shows the projection or tab on the neck of the tube entering the recess on the hinged lid.
FIG. 8 shows a variation on FIG. 7 with regard to the shape of the tab at the end of the neck of the tube.

The same result is obtained with the solution shown in FIG. 8. Here the tab (15) closing off the neck of the tube is a blind recess (16) of any internal section, and this matches the cross-section of a projection from the bottom of the hinged lid (4), which is not shown. The snap connection is similar in this case, and the tab (15) is broken when the lid (4) rotates.

FIG. 3 shows the position of the container's finger flap (6). This generally set to match the vertical line of the front depression on the tube (1)—the depression is not shown.

This device allows any type of combination required between relative positions of the finger flap and of the front depression—either both aligned prior to and following rotation of the lid, prior to rotation only or following rotation only.

What is claimed is:

1. A container for dispensing a product, the container (1) having a longitudinal axis (x—x) and a neck (5) through which the product can be dispensed, the container further comprising;

a cap (2) engaged on the container (1);

the cap (2) having a lower section (3) fixed to the neck (5) and a lid (4) engaged to the lower section (3) by a hinge (6) around which the lid (4) can be rotated to expose the neck (5) and closed;

wherein a bottom of the lower section (3) has a first opening defined by a flange (9) which is fixed to a base (8) on the neck (5);

the neck (5) having a second opening which is closed by a tab (13), the tab (13) fixed on the neck (5) as a unit around an entire circumference of the neck (5);

the lid (4) having a projection (11) which is snap engaged around the neck (5) over tab (13);

wherein the tab (13) is engaged within projection (11) when lid (4) is closed and provides a means for breaking the tab (13) off neck (5) when lid (4) is rotated around the longitudinal axis (x—x) of the container and opening the second opening in neck (5); and wherein the tab (13) thereafter remains within the projection (11) to indicate tampering when the lid (4) is rotated to expose neck (5).

2. The tube according to claim 1;

wherein a tamper indicating means comprises a pair of vertical recesses (14) opposite each other in projection (11) into which vertical fins 18 on tab 13 respectfully project.

3. The tube according to claim 1;

wherein lid (4) is snap engaged on the neck (5) by an annular projection (19) extending into an annular recess 20 on neck (5).

4. The tube according to claim 1;

wherein the vertical axis (22) of a flap (7) on the lid (4) for opening the lid (4) around hinge (6) is in vertical alignment with that of a depression (21) on the container (1) prior to and following rotation of the lid (4) around the axis (x—x).

5. The tube according to claim 1;

wherein a vertical axis (22) of a flap (7) on the lid (4) for opening the lid (4) around hinge (6) is in vertical alignment with that of a depression (21) on the container (1) only prior to rotation of lid (4) around the axis (x—x).

6. The tube according to claim 1;

wherein a vertical axis (22) of a flap (7) on the lid (4) for opening the lid (4) around hinge (6) is in vertical alignment with that of a depression (21) on the container only following rotation of the lid around the axis (x—x).

* * * * *